United States Patent [19]

Epper et al.

[11] 4,288,029

[45] Sep. 8, 1981

[54] SEPARATOR WITH PRESSURE-RESPONSIVE DISCHARGE

[75] Inventors: Wolfgang Epper, Bergheim-Zievenich; Wolfgang Heckmann, Bergisch-Gladbach, both of Fed. Rep. of Germany

[73] Assignee: Klöckner-Humboldt-Deutz AG, Fed. Rep. of Germany

[21] Appl. No.: 97,714

[22] Filed: Nov. 27, 1979

[30] Foreign Application Priority Data

Dec. 6, 1978 [DE] Fed. Rep. of Germany ..... 2852628

[51] Int. Cl.[3] ..... B04B 1/14

[52] U.S. Cl. ..... 233/20 A

[58] Field of Search ..... 233/20 R, 20 A, 19 R, 233/19 A, 47 R, 46, 47 A

[56] References Cited

U.S. PATENT DOCUMENTS 3,250,463 5/1966 Thylefors ..... 233/20 R 3,593,915 7/1971 Steinacker ..... 233/20 A 3,823,868 7/1974 Baram ..... 233/20 A

*Primary Examiner*—Robert W. Jenkins

*Attorney, Agent, or Firm*—Hill, Van Santen, Steadman, Chiara & Simpson

[57] ABSTRACT

A rotary separator has a separation vessel comprised of opposed conical sections and has an annular gap between the sections for discharge of solid material. A sleeve surrounds the separation vessel and is attached to the lower conical section thereof by a flexible member allowing axial sleeve movement. The sleeve carries a ring for comovement therewith displaceable to open and close the gap. When the pressure of material in the vessel is sufficient to overcome the flexibility characteristics of the material supporting the sleeve, discharge occurs. The flexible member may be pre-stressed to control the pressure required for discharge to occur, or a chamber communicating with the sleeve and flexible member may be pressurized to selectively displace the sleeve and ring and thereby control discharge.

6 Claims, 2 Drawing Figures

SEPARATOR WITH PRESSURE-RESPONSIVE DISCHARGE

BACKGROUND OF THE INVENTION

1. Field of the Invention

The present invention relates to rotary separators, and in particular to a rotary separator having a discharge operable in response to pressure exerted by separated material in the separator vessel.

2. Background of the Invention

Rotary separators for separating a solid-liquid mixture are known in the art which consist of opposed conical upper and lower sections having an annular gap therebetween. Such separators are symmetrical about the axis of rotation such that when the separation vessel is rotated the solid component accumulates at the area of greatest radius of the vessel and is drawn off through the annular gap.

A separator as described above is known, for example, from U.S. Pat. No. 3,823,868. As disclosed in that patent, the opening and closing of the annular gap is achieved by the use of a piston valve which surrounds the lower part of the separator vessel. The piston valve is axially movable and is fixed in a closed position by means of a spring and, together with the exterior wall of the lower part of the separator vessel, forms an annular pressure chamber into which a fluid is introduced in order to open the piston valve and allow discharge through the annular gap.

The piston valve disclosed in U.S. Pat. No. 3,823,868 slides in a metallic guide the purpose of which is to allow axial displacement of the valve without tilting, so that discharge is uniform around the entire circumference of the separator. In order to achieve such uniform discharge without tilting of the valve it is essential that the entire effective surface of the piston valve be uniformly charged with hydraulic fluid. This means that in terms of tolerances the piston valve, the metallic guide and the appertaining seals utilized in the construction of such separators must be designed not only to account for the deformations to be expected in the centrifugal force field, but also must account for differing temperatures of the solid-liquid mixture to be separated. In order to afford the widest possible range of use for such a separator, optimum values must be chosen so that when mechanical and/or thermally conditioned expansions result which deviate from the optimum values, effective and efficient separation and discharge is diminished.

It is therefore a problem in the art to achieve uniform discharge from a rotary separator in a manner which can be varied according to thermal and mechanical conditions associated with each type of mixture to be separated.

SUMMARY OF THE INVENTION

In accordance with the principles of the present invention a rotary separator having opposed upper and lower conical parts with a discharge gap between the parts is provided with a discharge valve to allow discharge in response to pressure produced in the interior of the vessel by separated solids as a result of centrifugal forces generated by rotation. It is an object of the present invention to provide a discharge valve for such a separator in which the valve is guided to provide uniform discharge with such guidance being substantially unaffected by changing mechanical and thermal conditions.

This object is inventively achieved through the utilization of an annular sleeve carried on the lower separator part and attached thereto by a flexible member allowing axial displacement of the sleeve. The sleeve carries a ring disposed in the annular gap which is comovable with the sleeve to open and close the gap.

A separator having such a valve is disclosed herein in three embodiments each of which utilizes the concept of opposing the discharge forces of the separated solids generated by rotation of the separator vessel until such forces result in an accumulated pre-selected pressure. In each embodiment a ring for opening and closing the discharge gap is guided so as to provide uniform discharge substantially independent of mechanical and thermal variables.

One embodiment of the invention utilizes a flexible member which interconnects the lower part of the separator vessel with an annular sleeve disposed immediately beneath the discharge gap. The sleeve carries an annular ring on an upper portion thereof which is displaceable to open and close the discharge gap. The flexibility characteristics of the connecting member are preselected so as to allow displacement of the annular ring only when a designated accumulated pressure is achieved in the interior of the separation vessel as a result of centrifugal forces operating on separated solids therein. The discharge gap is normally closed by the ring, however, when sufficient internal pressure is developed to overcome the flexibility characteristics of the connecting member, the ring is displaced and discharge occurs. In this embodiment, the piston valve has no movable seal which is subject to wear and because displacement of the ring results upon elastic deformation of the connection element, displacement of the ring is uniform around the entire circumference of the separator. The connection element not only fulfills the function of a biased spring, but also provides the piston valve with reliable guidance which is minimally effected by mechanical and thermal changes. Further, tooling difficulties in the dimensioning of the individual parts is minimized because the flexible connection member can compensate for deviation from tolerances.

In a second embodiment of the invention, the connection element between the lower separator vessel part and the annular sleeve is connected in such a manner that it is under axial prestress. Connecting the member in this manner provides an additional means for selecting the pressure at which discharge is desired because increasing the pre-stress of the flexible member will increase the pressure which must be developed by the solid to be separated in order for discharge to occur.

In a further development of the invention, the piston valve consisting of the sleeve and flexible member form together with the wall of the separation vessel two pressure chambers which are radially connected in series. The chambers can be pressurized with hydraulic fluid to selectively control displacement of the sleeve and ring attached thereto in order to selectively open and close the discharge gap. As discussed above, a problem with pressure-actuated discharge valves is that of achieving uniform pressure distribution in order to prevent tilting of the ring which opens and closes the discharge gap.

This problem is overcome by the utilization of two pressure chambers. The first chamber as seen in the direction of hydraulic fluid flow has the function of an acceleration chamber in which the hydraulic fluid supplied from a source which is at rest can be placed in rotation in accord with the rotation of the separation vessel. In separators of the type described which are rotational-symmetric, a closed fluid ring is formed at the outer circumference of the first chamber. The first and second chambers are radially disposed with the first chamber lying closer to the axis of rotation of the separator than does the second chamber.

Transfer of hydraulic fluid from the first chamber into the second chamber can be made dependent upon the development of a specific pressure within the first chamber, which pressure can be adjusted, for example, by the pre-stress of the flexible connection element. In this simple manner, the use of the two-chamber system provides uniform charging of the entire effective surface of the piston valve, i.e., the annular ring, with hydraulic fluid thereby significantly diminishing tilting of the effective surface and improving uniform solids discharge.

The second pressure chamber as seen in the radial direction may be equipped with discharge nozzles with an adjustable flow-cross section. The discharge of hydraulic fluid from the second chamber thus effects a decrease of pressure available to move the piston valve, so that the closing of the discharge gap can be retarded or accelerated by controlling the discharge velocity of hydraulic fluid from the second chamber.

Further features and advantages of the invention will be apparent from the following sample embodiments and the accompanying drawings.

DESCRIPTION OF THE PREFERRED EMBODIMENTS

Figure 1:
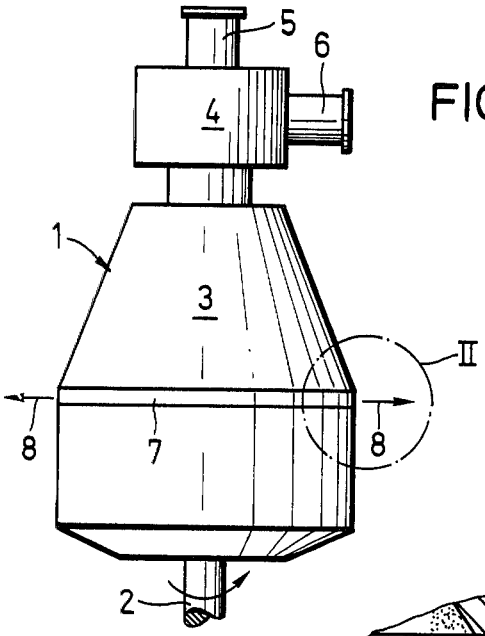
FIG. 1 is a side elevational view of a rotational-symmetric separator in simplified form showing only elements necessary to describe the invention.

A rotary separation device for separating a solid-liquid mixture is designated generally at 1 in FIG. 1. The device 1 consists of a separator vessel 3 which is mounted for corotation on an axial shaft 2. The separator vessel 3 consists of an upper conical part 10 and a lower conical part 9, shown in greater detail in FIG. 2.

The separator 1 has a stationary part 4 which receives an introduction pipe 5 through which a solid-liquid mixture to be separated is introduced into the separator 1, and also receives a discharge pipe 6 through which separated liquid is discharged.

The separation vessel 3 has an annular gap 7 between the upper part 10 and the lower part 9 through which separated solid is discharged at intervals in the direction of the arrows 8. Discharge of the separated solid occurs as a result of pressure developed in the interior of the separator generated by the centrifugal forces derived from rotation of the vessel 3.

Figure 2:
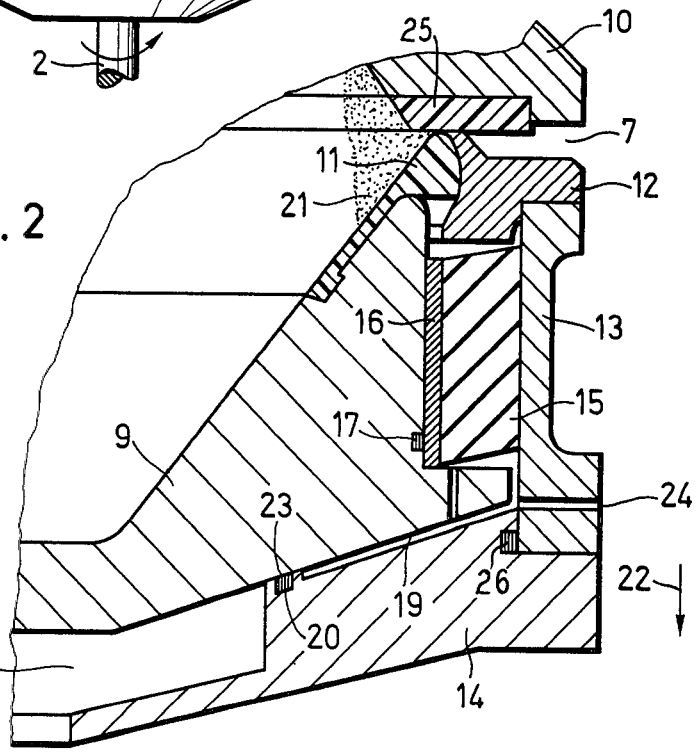
FIG. 2 is a detailed sectional view of the Area II designated in FIG. 1.

As shown in detail in FIG. 2, the lower conical part 9 is provided with a sealing lip 11 which normally abuts a cooperating seal 25 carried on the upper conical part 10 to prevent discharge of separated solid material 21 through the discharge gap 7. The sealing lip 11 is attached not only to the lower conical part 9, but also to an annular ring 12 which surrounds the vessel 3.

The ring 12 is attached to an annular sleeve 13, which also surrounds the vessel 3, and the sleeve 13 is in turn attached to the lower conical part 9 by means of a flexible element 15 and an interior sleeve 16.

In one embodiment of the invention, the sleeve 13 is allowed limited axial movement so that by selectively choosing the flexibility characteristics of the connecting element 15, separated material 21 can be retained in the separation vessel 3 until the solid material 21 develops sufficient pressure to overcome the flexibility characteristics of the connecting element 15 and force the sealing lip 11, the ring 12 and the sleeve 13 downward, allowing discharge.

Additional control over the discharge pressure can be achieved by axially pre-stressing the connecting element 15 by decreasing the interior radius of the sleeve 13, or increasing the exterior radius of the sleeve 16 or the lower conical part 9. When the connecting element 15 is pre-stressed in this manner, a higher pressure must be developed by the separated solid 21 in order for discharge to occur.

Continuing with the structure illustrated in FIG. 2, the sleeve 13 may extend to a plate 14 disposed beneath the lower conical part 9 and is attached to the lower plate 14 in sealed relation by means of a sealing ring 26. A similar sealing ring 17 maintains a sealed relation between the interior sleeve 16 and the lower conical part 9.

The bottom plate 14 has channels therein such that when abutting the lower conical part 9, a first chamber 18 and a second chamber 19 are formed. A seal 20 normally prevents communication between chambers 18 and 19. The chambers 18 and 19 are radially connectable by displacement of the plate 14 in the direction of the arrow 22. As can be seen from FIG. 2, the chamber 18 is closer to the axis of rotation of the vessel 3 than is the chamber 19 and has a greater volume so that the chamber 18 can be filled with hydraulic fluid while the chamber 19 remains empty by operation of the seal 20.

Hydraulic fluid is introduced to the chamber 18 from a stationary source and the hydraulic fluid will, because of the rotation of the separation vessel 3, immediately form a fluid ring in the chamber 18 which rotates together with the separation vessel 3. The pressure in the chamber 18 increases with increased introduction of fluid, particularly at locations lying at a greater distance from the axis of rotation so that beginning with a specific pressure which may be determined by the prestress of the connection element 15, the bottom plate 14 will be displaced downward in the direction of the arrow 22 allowing transfer of hydraulic fluid into the second pressure chamber 19 at the location 23.

Displacement of the lower plate 14 in this manner pulls the sleeve 13 in the direction of the arrow 22 which is guided by the flexible element 15 and moves the ring 12 downward along with the sealing lip 11 to allow discharge of solid material 21. The time and amount of discharge can thus be controlled by selective introduction of hydraulic fluid to the chamber 18, and is further controlled by pre-selection of the pre-stressing on the connection element 15. Discharge will continue until the pressure in the chambers 18 and 19 is sufficient to overcome the reset force of the connection element 15 and the pressure developed by the material 21, which pressure decreases as discharge continues.

Further control of the time and amount of discharge can be achieved as is shown in FIG. 2 wherein the sleeve 13 is provided with a discharge nozzle 24 allowing discharge of hydraulic fluid from the chamber 19. The discharge nozzle 24 may be provided with an adjustable cross section so that changes in hydraulic fluid pressure in the chamber 19 can be accelerated or retarded in order to accelerate or retard closing of the gap 7.

The flexible element 15 may consist, for example, of rubber, and can be vulcanized to the sleeve 13 and the interior sleeve 16. Other suitable flexible materials are known to those skilled in the art and may be substituted without departing from the inventive concept herein.

Other modifications and changes may be suggested by those skilled in the art, however, it is the intention of the inventors to embody within the patent warranted hereon all changes and modifications as reasonably and properly come within the scope of their contribution to the art.

We claim as our invention:

1. A separator for separating materials of different densities consisting of:

a rotational-symmetric separation vessel having at least one discharge aperture disposed on a circumference thereof;

an annular sleeve spaced from said separation vessel and forming a piston valve in cooperation therewith having a chamber which is chargeable with a pressure medium and which surrounds the exterior of the separation vessel and normally blocks said discharge aperture;

a flexible connection element radially attached between the sleeve and the separation vessel, said connection element permitting limited uniform axial displacement of and guiding said sleeve to open and close said aperture, said connection element further having a selected flexibility to normally oppose interior pressure developed in said separator and to allow piston valve displacement and material discharge upon developement of a selected interior pressure.

2. The separator of claim 1 wherein said connection element is radially attached between the sleeve and the separation vessel under axial pre-stress.

3. The separator of claim 1 wherein said separator vessel is comprised of opposed upper and lower conical parts and said discharge aperture is disposed between said upper and lower parts, and wherein said piston valve further comprises the combination of:

said annular sleeve surrounding a portion of said lower conical part, said sleeve being disposed immediately beneath said discharge aperture and being attached to said lower conical part by said connection element;

an annular ring carried on a top of said annular sleeve, said ring extending into said discharge aperture; a sealing lip disposed in said discharge aperture and attached to said ring and said lower conical part, said sealing lip displaceable to allow material discharge upon comovement of said ring and sleeve to an open position.

4. The separator of claim 3 wherein said piston valve further comprises a bottom plate disposed adjacent and beneath said lower conical part, said lower plate having channels in a surface thereof adjacent said lower conical part defining at least two normally non-connected pressure chambers in cooperation with said lower conical part, said lower plate connected to said annular sleeve for axial comovement therewith upon introduction of a pressure medium into said pressure chambers.

5. The separator of claim 4 wherein said channels on said lower plate are annular and concentric and a first annular channel forms a first pressure chamber disposed radially inwardly with respect to a second annular channel which forms a second pressure chamber, and wherein said second pressure chamber has a smaller volume than said first pressure chamber, and wherein a sealing means is disposed between said chambers, said sealing means being broken upon development of a pre-selected pressure on said first pressure chamber to allow pressure medium flow to said second pressure chamber to displace said piston valve.

6. The separator of claim 5 wherein said second pressure chamber is equipped with a variable cross-section discharge nozzle for controlled acceleration or retardation of piston valve displacement.

* * * * *